US011039696B2

(12) United States Patent
Perry

(10) Patent No.: US 11,039,696 B2
(45) **Date of Patent: *Jun. 22, 2021**

(54) USER RESTRAINT APPARATUS

(71) Applicant: Michael J. Perry, Albany, OR (US)

(72) Inventor: Michael J. Perry, Albany, OR (US)

( * ) Notice: Subject to any disclaimer, the term of this patent is extended or adjusted under 35 U.S.C. 154(b) by 663 days.

This patent is subject to a terminal disclaimer.

(21) Appl. No.: 15/912,563

(22) Filed: Mar. 5, 2018

(65) Prior Publication Data

US 2018/0192789 A1 Jul. 12, 2018

Related U.S. Application Data

(63) Continuation of application No. 14/714,039, filed on May 15, 2015, now Pat. No. 9,907,412.

(60) Provisional application No. 61/993,503, filed on May 15, 2014, provisional application No. 62/036,582, filed on Aug. 12, 2014.

(51) Int. Cl.
*A47D 15/00* (2006.01)
*A47D 5/00* (2006.01)

(52) U.S. Cl.
CPC ..... *A47D 15/005* (2013.01); *A47D 5/00* (2013.01)

(58) Field of Classification Search
CPC ..... A47D 13/08; A47D 15/008; A47D 5/006; A47D 13/083; A47D 15/003; A47D 15/005; A47D 5/00; A47D 13/00; A47D 15/00; A47D 9/005; A47D 13/061; A61F 5/3769; A61F 5/3707; A61F 5/3776; A61F 5/37; A61F 5/3723; A61F 5/0006; A61B 90/14; A61B 6/0421; A61B 6/04; A61B 6/0428; A61B 5/0555; A61B 5/3707; A61B 5/3776; A61B 5/37; A61B 5/3723; A61B 5/0006
See application file for complete search history.

(56) References Cited

U.S. PATENT DOCUMENTS

| | | | |
|---|---|---|---|
| 4,205,669 | A | 6/1980 | Hamann |
| 6,009,874 | A | 1/2000 | Sartin et al. |
| 6,755,198 | B2 | 6/2004 | Parker |
| 7,065,814 | B2 | 6/2006 | Rutkowski |
| 7,178,877 | B2 | 2/2007 | Watson |

(Continued)

OTHER PUBLICATIONS

"Kabooti Comfort Cushion", ChangingBuddy, downloaded Apr. 18, 2014, pp. 4, http://www.changingbuddy.com/.

(Continued)

*Primary Examiner* — Ophelia A Hawthorne
(74) *Attorney, Agent, or Firm* — Kunzler Bean & Adamson. PC

(57) ABSTRACT

Apparatuses, systems, and methods are presented for restraining a user. An apparatus includes an underlay segment and a barrier panel. The underlay segment is positionable underneath at least one of the shoulders, the head, the back, and the buttocks of the user lying in the supine position. The barrier panel is coupled to the underlay segment and is extendable around the chest of the user to form a partition between an upper body portion and a lower body portion of the user. A proximal edge of the barrier panel is shaped to contour and rest on the chest or abdomen of the user so that engagement between the proximal edge and the user supports a distal edge of the barrier panel to extend outwardly and upwardly from the upper body portion of the user. The barrier panel is foldable.

20 Claims, 15 Drawing Sheets

(56) References Cited

U.S. PATENT DOCUMENTS

| | | | | |
|---|---|---|---|---|
| 8,117,698 | B1 | 2/2012 | Khaze | |
| 8,695,137 | B1 | 4/2014 | Hanson | |
| 9,907,412 | B2 * | 3/2018 | Perry | A47D 15/005 |
| 2009/0007336 | A1 | 1/2009 | Kassai et al. | |
| 2009/0313756 | A1 | 12/2009 | Rogers | |
| 2013/0312198 | A1 | 11/2013 | Kelly | |
| 2015/0128349 | A1 | 5/2015 | Padilla et al. | |

OTHER PUBLICATIONS

"HALO SwaddleChange Change Pad Cover", HALO, downloaded Apr. 18, 2014, pp. 3, http://www.halosleep.com/halo-swaddlechange-changing-pad-cover/.

* cited by examiner

USER RESTRAINT APPARATUS

CROSS-REFERENCE TO RELATED APPLICATION

This application is a continuation of and claims priority to U.S. patent application Ser. No. 14/714,039 entitled "DIAPER CHANGING APPARATUS" filed on May 15, 2015 for Michael J. Perry, now U.S. Pat. No. 9,907,412, which claims the benefit of U.S. Provisional Patent Application No. 61/993,503, filed May 15, 2014, and U.S. Provisional Patent Application No. 62/036,582, filed Aug. 12, 2014, each of which are incorporated herein by reference for all purposes.

FIELD

The subject matter of the present disclosure relates generally to user restraints. More specifically, this application relates to user restraints that prevent a user from reaching below their waste, interfering with a diaper changing process or the like.

BACKGROUND

Changing a baby's diaper can be a frustrating experience, especially when the diaper contains excrement. During a diaper changing procedure, many babies, whether consciously or subconsciously, move their hands into contact with the dirty diaper, the excrement, and/or their own soiled buttocks. Not only must a diaper changing attendant be able to remove the diaper and clean the buttocks of the baby, the diaper changing attendant must position the baby's lower body (e.g., hold the legs of the baby) in a desired position for changing and still be able to fend off the moving hands of the baby so that the baby's hands do not contact the soiled diaper and/or the excrement. Accordingly, diaper changing attendants generally need to simultaneously perform three separate tasks, cleaning the buttocks, positioning the lower body, and repelling the hands of the baby.

Conventional solutions to this problem include, among others, asking another person to assist with the diaper changing procedure, instructing the child to not touch the diaper/excrement, or somehow securing the baby's hands in a fixed position to prevent the hands from moving into contact with the diaper/excrement. However, these solutions are inefficient, impractical, and often cause the baby (and the diaper changing attendant) to experience discomfort and stress.

SUMMARY

From the foregoing discussion, it should be apparent that a need exists for a user restraint apparatus that overcomes the difficulties that are associated with conventional user restraint techniques. Beneficially, such an apparatus would improve the ease, efficiency, and effectiveness of a diaper changing procedure, or the like.

The subject matter of the present application has been developed in response to the present state of the art, and in particular, in response to the problems and needs in the art that have not yet been fully solved by currently available user restraints. Accordingly, the present disclosure has been developed to provide a user restraint apparatus that overcome many or all of the above-discussed shortcomings in the art.

Disclosed herein is one embodiment of a user restraint apparatus. The apparatus includes an underlay segment positionable underneath at least one of the shoulders, the head, the back, and the buttocks of the user lying in the supine position. The apparatus further includes a barrier panel coupled to the underlay segment. The barrier panel is extendable around the chest of the user to form a partition between an upper body portion and a lower body portion of the user, with the barrier panel having a proximal edge and a distal edge. The proximal edge is shaped to contour the chest or abdomen of the user. The barrier panel is foldable.

In certain embodiments, the proximal edge is shaped to rest on the chest or abdomen of the user so that engagement between the proximal edge and the chest or abdomen of the user supports the distal edge that extends outwardly and upwardly from the upper body portion of the user. In one implementation, the underlay segment and the barrier panel are permanently connected. In such an implementation, the underlay segment and the barrier panel are formed of the same, unitary material. However, in another implementation, the underlay segment and the barrier panel are detachably coupled together.

In yet another implementation, the apparatus further includes a changing pad extending from the underlay segment so that the changing pad is positionable underneath at least part of the lower body portion of the user. In such an implementation, the changing pad, the underlay segment, and the barrier panel may be permanently connected. In another implementation, the changing pad and the underlay segment are detachably coupled together. The changing pad may also include a wipe dispenser portion. The apparatus may be constructed from a flexible, foldable, non-rigid material. For example, the apparatus may be foldable to form a pouch for holding diaper changing supplies.

In another implementation, the barrier panel further includes attachment means for securing the barrier panel around the chest of the user. The barrier panel may also include adjustment means for adjusting to the size of the user or stiffener means for imparting sufficient structure to the barrier panel to prevent the barrier panel from collapsing, thereby maintaining at least a portion of the barrier panel suspended above the lower body portion of the user. In one implementation, the proximal edge of the barrier panel is substantially c-shaped.

Also disclosed herein is another embodiment of a user restraint apparatus. The apparatus includes an underlay segment positionable underneath at least one of the shoulders, the head, the back, and the buttocks of the user lying in the supine position. The apparatus further includes a barrier panel coupled to the underlay segment. The barrier panel is extendable around the chest of the user to form a partition between an upper body portion and a lower body portion of the user, with the barrier panel having a proximal edge and a distal edge. The proximal edge is shaped to contour the chest or abdomen of the user and to rest on the chest or abdomen of the user and the distal edge extends outwardly and upwardly from the upper body portion of the user. The barrier panel is foldable. Still further, the apparatus includes a changing pad extending from the underlay segment so the changing pad positionable underneath at least part of the lower body portion of the user.

In one implementation, the apparatus is foldable to form a pouch for holding diaper changing supplies. In another implementation, the barrier panel further includes attachment means for securing the barrier panel around the chest of the user and/or adjustment means for adjusting to the size of the user.

Disclosed herein is also one embodiment of a method for restraining a user. The method includes positioning the user in the supine position on an underlay segment, wherein at least one of the shoulders, the head, the back, and the buttocks of the user are in contact with the underlay segment. The method further includes extending a barrier panel that is coupled to the underlay segment around the chest or abdomen of the user to form a partition between an upper body portion and a lower body portion of the user, wherein the barrier panel comprises a proximal edge that rests against the chest or abdomen of the user and wherein the barrier panel is foldable.

Reference throughout this specification to features, advantages, or similar language does not imply that all of the features and advantages that may be realized with the present disclosure should be or are in any single embodiment of the invention. Rather, language referring to the features and advantages is understood to mean that a specific feature, advantage, or characteristic described in connection with an embodiment is included in at least one embodiment of the subject matter disclosed herein. Thus, discussion of the features and advantages, and similar language, throughout this specification may, but do not necessarily, refer to the same embodiment.

Furthermore, the described features, advantages, and characteristics of the disclosure may be combined in any suitable manner in one or more embodiments. One skilled in the relevant art will recognize that the subject matter of the present application may be practiced without one or more of the specific features or advantages of a particular embodiment. In other instances, additional features and advantages may be recognized in certain embodiments that may not be present in all embodiments of the disclosure. Further, in some instances, well-known structures, materials, or operations are not shown or described in detail to avoid obscuring aspects of the subject matter of the present disclosure. These features and advantages of the present disclosure will become more fully apparent from the following description and appended claims, or may be learned by the practice of the disclosure as set forth hereinafter.

BRIEF DESCRIPTION OF THE DRAWINGS

In order that the advantages of the subject matter of the present disclosure will be readily understood, a more particular description of the subject matter will be rendered by reference to specific embodiments that are illustrated in the appended drawings. Understanding that these drawings depict only typical embodiments of the subject matter of the present disclosure and are not therefore to be considered to be limiting of its scope, the subject matter will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the subject matter of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the subject matter of the present disclosure, however, absent an express correlation to indicate otherwise, an implementation may be associated with one or more embodiments.

Figure 1:
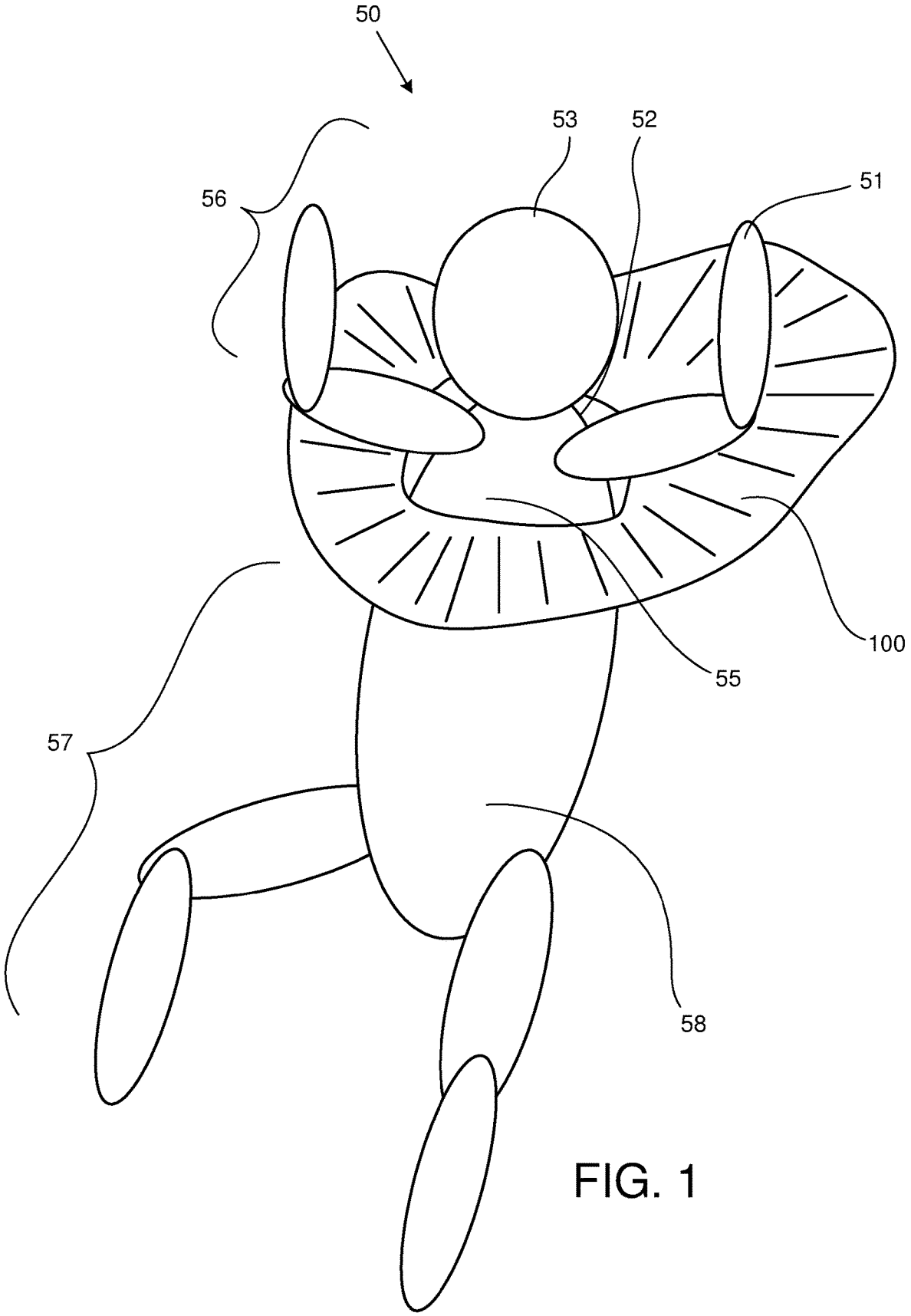
FIG. 1 is a top perspective view of one embodiment of a baby in the supine position with a diaper changing apparatus arranged around the baby.

FIG. 1 is a top perspective view of one embodiment of a baby 50 in the supine position with a diaper changing apparatus 100 arranged around the baby 50. The When the diaper changing apparatus 100 is arranged around the baby 50, as depicted, the hands 51 of the baby are prevented from interfering with the diaper changing process. As briefly described above, many babies, whether consciously or subconsciously, move their hands into contact with the diaper that contains the excrement and/or their own soiled buttocks during a diaper changing procedure. The diaper changing apparatus 100 of the present disclosure generally provides a cone-like barrier panel (described in greater detail below) that forms a partition between the upper body portion 56 and the lower body portion 57 of the baby, thus preventing the baby's hands 51 from interfering with (e.g., touching the excrement or soiled diaper) the diaper changing procedure while still allowing the baby 50 to move his/her hands 51 in a substantial range of motion. In other words, the diaper changing apparatus 100 of the present disclosure prevents contact with the soiled diaper and the excrement but does not completely restrict the baby's hands 51 in a fixed position during the changing procedure, thus avoiding the stressful and uncomfortable situation of tying-down, holding down, or otherwise suppressing the baby's hand movements. In other words, the baby's hands are still allowed to move but are restricted from contacting his/her lower body portion 56 and the soiled diaper 58.

As described in greater detail below with reference to the figures, the diaper changing apparatus includes an underlay segment and a barrier panel. To use the diaper changing apparatus 100, the underlay segment is placed underneath at least one of the shoulders 52, head 53, back, and buttocks of a baby 50 in the supine position while the barrier panel extends around the chest 55 of the baby 50 to form a partition, specifically isolating the upper body portion 56 of the baby from the lower body portion 57 and the diaper 58.

Figure 2A:
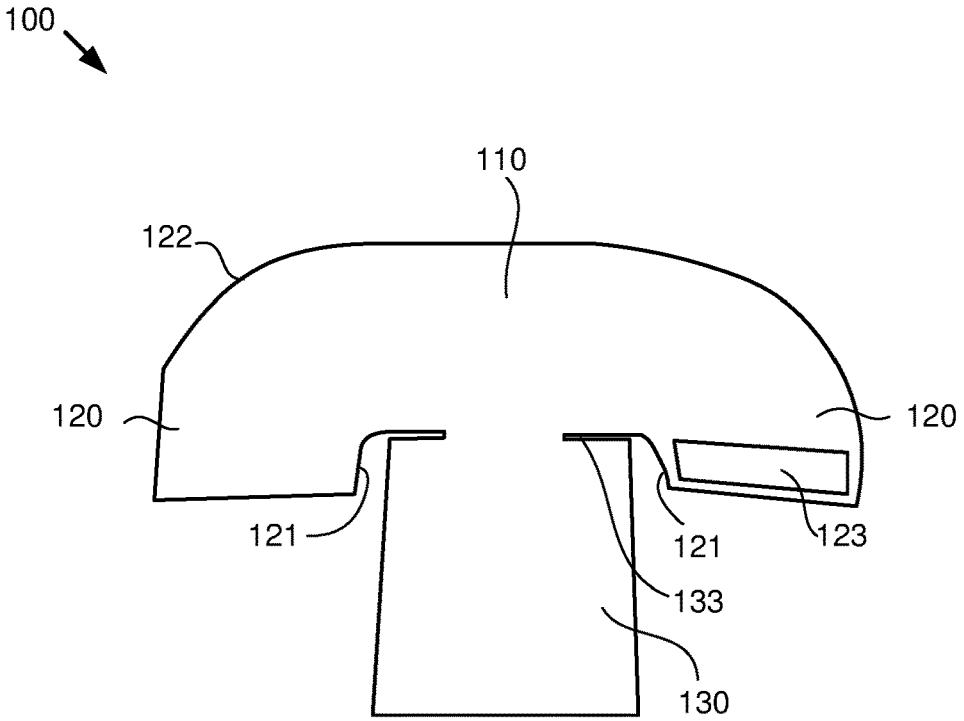
FIG. 2A is a top view of one embodiment of a diaper changing apparatus in a pre-installed position.

FIG. 2A is a top view of one embodiment of a diaper changing apparatus 100 in a pre-installed position. The diaper changing apparatus 100 includes an underlay segment 110 and a barrier panel 120. In certain implementations, the diaper changing apparatus 100 may further include a changing pad 130 that extends the length of the baby to protect the surface upon which the baby is laid from inadvertent urine and excrement spillage. In one embodiment, the portions 110, 120, 130 of the diaper changing apparatus 100 may be formed of a single, unitary piece of material. In such an embodiment, the portions 110, 120, 130 may not be physically distinguished by borders, seams, or other distinctive margins or boundaries. Accordingly, the labeling and use of the terms "underlay segment" 110, "barrier panel" 120, and "changing pad" 130 do not necessarily refer to separate and physically distinguishable components but instead refer to segments that perform a certain function or assume a certain configuration when the apparatus 100 is in an installed position (e.g., arranged about a baby 50—see FIG. 1).

In other embodiments, all or some of the portions 110, 120, 130 may be physically distinguished from one another. For example, as described in greater detail below, the barrier panel 120 may be detachable from the underlay segment 110, which is in turn detachable from the changing pad 130. In another example, the underlay segment 110 and the barrier panel 120 may be integrally formed of the same piece of material and may rest on, or detachably couple to, a separate changing pad 130. The apparatus 100 and its various portions 110, 120, 130 may be constructed from textiles, plastics, polymers, composites, etc. In one embodiment, at least the barrier panel 120 is constructed from a material that is foldable and/or that is non-rigid, thus allowing the barrier panel 120 to lay down flat to allow the apparatus to be easily stored, transported, folded, and/or collapsed.

In one embodiment, the apparatus 100 includes a slot 133 disposed between the changing pad 130 and the barrier panel 120. The slot 133 essentially allows the proximal edge 121 of the barrier panel 120 to extend further inwards relative to the changing pad 130, thus allowing the changing pad 130 to remain substantially flat when the barrier panel 120 is extended around the baby. In certain embodiments in which the slot 133 is not included, the action of extending the barrier panel 120 around the baby may cause the changing pad 130 to partially wrap around the sides of the baby. In one implementation, it is undesirable for the changing pad 130 to at least partially wrap around the sides of the baby and therefore the slots 133 may be included in the configuration of the apparatus 100. In another implementation, however, wrapping the changing pad 130 at least partially around the sides of the baby may provide additional stabilization to the baby during the diaper changing process, thus inhibiting the side-to-side (e.g., roll-over) movements of the baby. In such an implementation, the slots 133 may not be included (as shown, for example, in FIGS. 3C, 3D, 4C, and 8).

FIG. 2A further shows various edges of the apparatus 100. The barrier panel 120 has a proximal edge 121 that contours around the chest 55 of the baby 50. The barrier panel 120 is detachably held in place around the chest 55 of the baby 50 by attachment means 123, which are described in greater detail below with reference to FIGS. 3A-3D. Together with the underlay segment 110, the proximal edge 121 forms a chest gap that secures around the baby's chest 55. Additional details regarding the proximal edge 121 are included below with reference to FIGS. 3E, 4B, and 5A-5B. A distal edge 122 is formed by the exterior edges of the barrier panel 120 and the exterior edges of the underlay segment 110. When in an installed position, the distal edge 122 may resemble a circular or elliptical conic (e.g., a curve intersecting a cone). In another embodiment, the distal edge 122 of the barrier panel can have other shapes, such as a straight line, a triangular shape, a rectangular shape, a circular shape, etc.

Figure 2B:
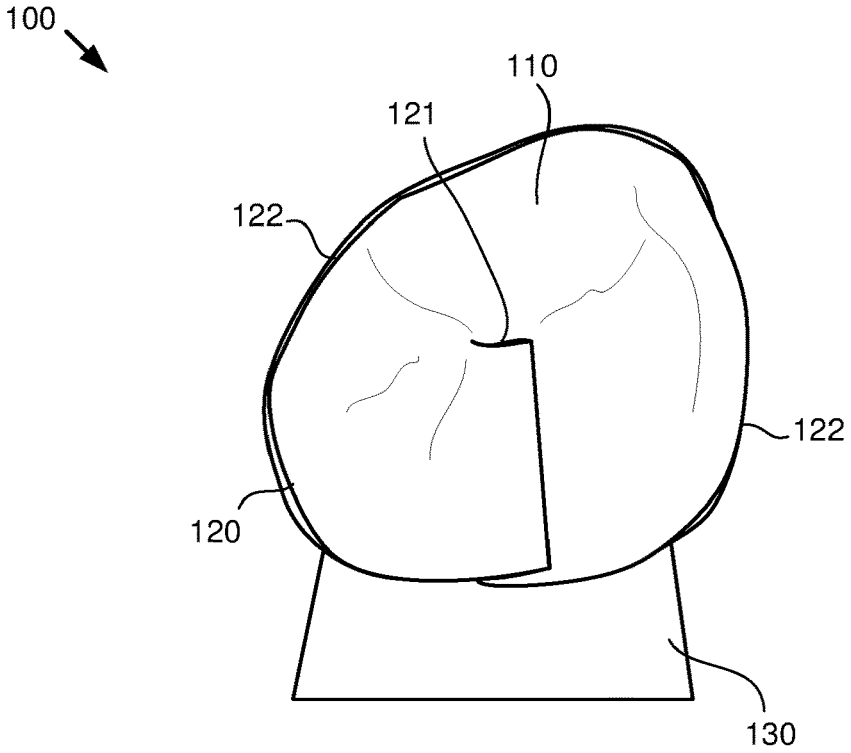
FIG. 2B is a perspective view of one embodiment of a diaper changing apparatus with a barrier panel forming a cone-like shape (baby not depicted)

FIG. 2B is a perspective view of one embodiment of the diaper changing apparatus 100 with the barrier panel 120 forming a cone-like shape (baby 50 not depicted). Because there is no baby 50 resting on the underlay segment 110 in the depicted embodiment, the weight of the barrier panel 120 has pulled the underlay segment 110 from its typical installed position (e.g., flat on the ground) into a substantially vertical position. The proximal edge 121, although its location is labeled in the figure, is not readily visible in FIG. 2B because the chest gap formed between the proximal edge 121 of the barrier panel 120 and the underlay segment 110 is collapsed in the depicted embodiment because the proximal edge 121 is not supported by resting on the chest 55 of a baby 50.

According to the embodiment depicted in FIG. 2B, the barrier panel 120 forms a cone-like shape, with the distal edge 122 forming a conic base. The barrier panel 120, according to one embodiment, is made from a material that is stiff enough (see description of FIG. 3E) to maintain a barrier despite the occasional collision from the hand 51 of a baby and the pull of gravity (e.g., the weight of the barrier panel itself). Referring back to FIG. 1, the barrier panel 120 extends outwardly and upwardly from the upper body portion 56 of the baby 50 (e.g., upwardly and outwardly from the underlay segment 110). In one embodiment, at least a portion of the barrier panel 120, when installed about a baby 50, is elevated/suspended above the lower body portion 57 of the baby 50. In other words, the cone-like shape of the barrier panel 120 may be designed and oriented so that, if the cone-like shape of the barrier panel 120 were to collapse, deform, bend, or stretch due to gravity and/or the force of a collision from the hand 51 of a baby 50, the barrier panel 120 would collapse, deform, bend, or stretch towards the lower body portion 57 of the baby 50 instead of towards the upper body portion 56 (e.g., the barrier panel 120 would not fall onto the head or face of the baby).

Figure 3A:
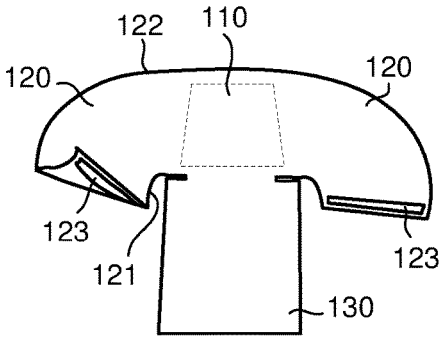
FIG. 3A is a top view of one embodiment of a diaper changing apparatus showing an attachment means for coupling a barrier panel about a baby (not depicted)

FIG. 3A is a top view of one embodiment of the diaper changing apparatus 100 showing an attachment means 123 for coupling the barrier panel 120 about a baby 50 (not depicted). The attachment means 123 is for detachably coupling the barrier panel 120 about the chest 55 of a baby 50. In one embodiment, the attachment means 123 may be a Velcro®-type fastener that allows a diaper changing attendant to quickly and efficiently couple and uncouple the barrier panels 120 about the baby 50. As depicted, a Velcro® "hooks" section may be disposed on one end of one of the "arms" of the barrier panel 120 and a Velcro® "loops" section may be disposed on the other side of the other "arm" of the barrier panel 120, thus allowing the ends of the two arms of the barrier panel 120 to partially overlap in order to couple together around the chest 55 of a baby 50.

Figure 3B:
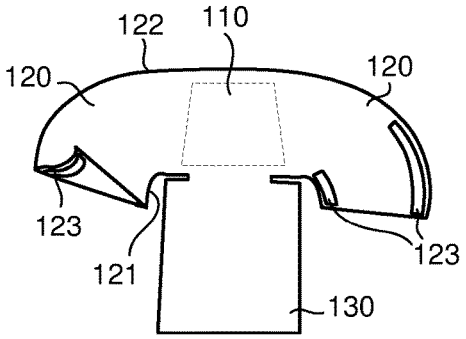
FIG. 3B is a top view of another embodiment of a diaper changing apparatus showing an attachment means and an adjustment means for coupling a barrier panel about a baby (not depicted)

FIG. 3B is a top view of another embodiment of the diaper changing apparatus 100 showing an attachment means 123 and an adjustment means for coupling the barrier panel 120 about a baby (not depicted). In the depicted embodiment, the attachment means 123 may include strips or sections of fastener material that extend along at least portion of one or both of the edges 121, 122 of the barrier panel 120. With the fastener material extending along one or both of the edges 121, 122, the diaper changing attendant may select, based on the size/age of the baby, how large to make the chest gap by adjusting the extent of overlap between the two arms of the barrier panel 120. In other words, corresponding fastener strips 123 on opposite sides of the arms of the barrier panel 120 may be aligned and fastened together along their respective lengths to according to the desired size of the chest gap (e.g., similar to an adjustable baseball cap that has fastener that allows the circumference of the cap to be modified).

In another embodiment, the apparatus 100 may optionally include multiple parallel strips or sections of corresponding fastener material (i.e., multiple strips of the fastener material of FIG. 3A), thus allowing a diaper changing attendant to select, based on the size/age of the baby, how large to make the chest gap, formed by the proximal edges 121 and the underlay segment 110 (e.g., adjusting how tightly the proximal edges 121 contour the chest 55 of the baby 50). Therefore, in one embodiment the adjustment means includes multiple attachment points to allow the diaper changing attendant to connect certain connection points to adjust the size of the chest gap.

Figure 3C:
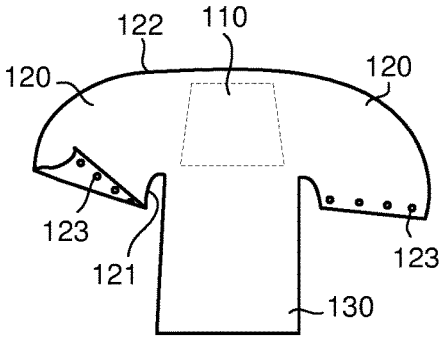
FIG. 3C is a top view of another embodiment of a diaper changing apparatus showing an attachment means for coupling a barrier panel about a baby (not depicted)
Figure 3D:
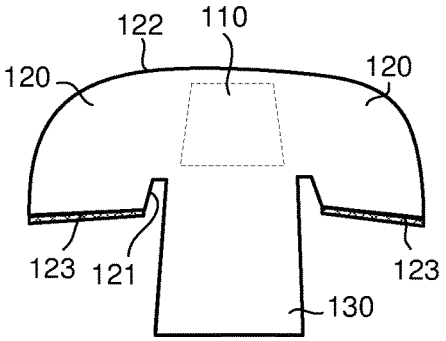
FIG. 3D is a top view of yet another embodiment of a diaper changing apparatus showing an attachment means for coupling a barrier panel about a baby (not depicted)

FIG. 3C is a top view of another embodiment of the diaper changing apparatus 100 showing an attachment means for coupling the barrier panel 120 about a baby (not depicted). That attachment means 123 may include snaps, buttons, ties, straps, laces, fasteners or other detachable coupling mechanisms. For example, FIG. 3D is a top view of yet another embodiment of the diaper changing apparatus 100 showing another example of an attachment means 123 for coupling the barrier panel 120 about a baby 50. The attachment means 123 may include a zipper or other edge coupling mechanism, thus not requiring the two "arms" of the barrier panel 120 to overlap.

Figure 3E:
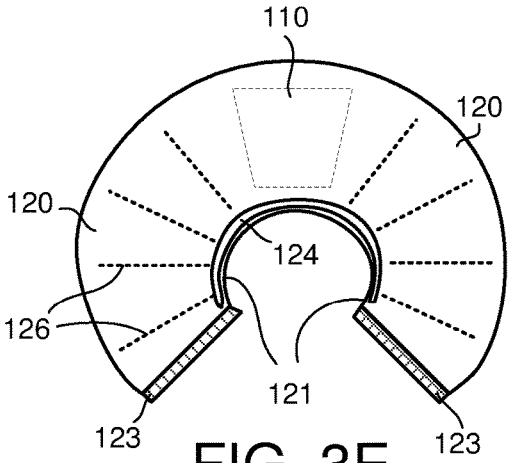
FIG. 3E is a top view of one embodiment of stiffeners installed within a barrier panel of a diaper changing apparatus.

FIG. 3E is a top view of one embodiment of stiffeners 126 and adjustment means 124 installed within a barrier panel of a diaper changing apparatus 100. In the depicted embodiment, the apparatus 100 does not include a changing pad 130 but includes a single section of material that has a portion (underlay segment 110) that wraps underneath at least one of the head, shoulders, back, and buttocks of a baby and another portion (barrier panel 120) that wraps around the chest of the baby.

As described above, in one embodiment the material of the barrier panel 120 is sufficiently stiff so as to maintain the shape of the barrier panel without the aid of stiffeners. However, in other embodiments the barrier panel 120 may be implemented with stiffeners 126 to facilitate maintaining the cone-like shape. For example, the barrier panel 120 may include at least one stiffener 126 that extends between the distal edge 122 and the proximal edge 121. In one embodiment, the stiffeners 126 may be rods that are disposed within the material of the barrier panel 120. In other words, the material may be a fabric and may include internal pockets that are configured to hold the stiffeners 126 in a desired orientation. In one embodiment, the barrier panel 120 may have a pleated or other folded/overlapping design that functions to strengthen the material and impart stiffness to the barrier panel 120. In one embodiment, not depicted, a stiffener 126 may be integrated with the barrier panel 120 along the distal edge 122 in order to maintain the conic curve. The stiffeners may be constructed from metallic, plastic, polymeric, or composite materials, among others. In another embodiment, the stiffeners may be foam members that impart a degree of structural stability while still being soft and at least somewhat pliable.

The adjustment means 124 for allowing a diaper changing attendant to adapt the size of the chest gap to the size of the baby 50 may be implemented using an elastic band integrated along the proximal edge 121 (as depicted in FIG. 3E). In such an embodiment, the proximal edge 121 would be held securely and snugly against the chest 55 of a baby 50, thus impeding the hands of a baby from slipping through the chest gap along the torso of the baby.

Figure 3F:
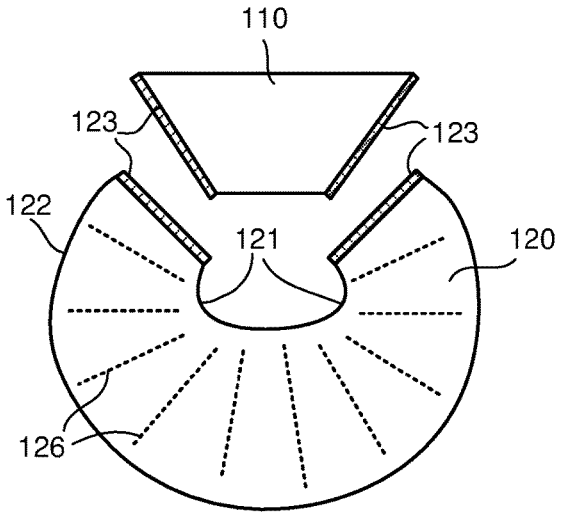
FIG. 3F is a top view of one embodiment of a diaper changing apparatus showing an underlay segment that is detachable from a barrier panel.

FIG. 3F is a top view of one embodiment of the diaper changing apparatus 100 showing an underlay segment 110 that is detachable from the barrier panel 120. As briefly described above, the various portions 110, 120 of the apparatus 100 may be detachably coupled together. For example, the barrier panel 120 may couple, via attachment means 123, to a separate underlay segment 110. In one embodiment, the underlay segment 110 may be an existing changing pad that is retro-fitted with complimentary attachment means 123. In other words, the underlay segment 110 may be partially or entirely formed from an existing changing pad, according to one embodiment.

Figure 4A:
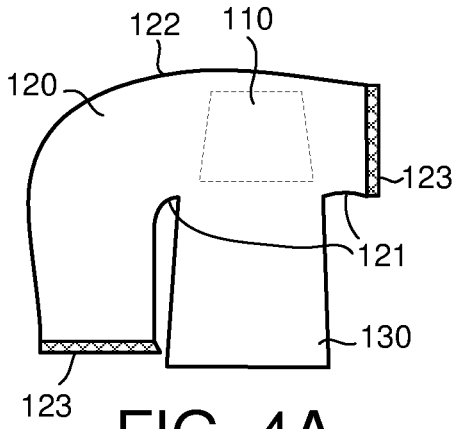
FIG. 4A is a top view of one embodiment of a diaper changing apparatus showing an asymmetrical barrier panel.
Figure 4B:
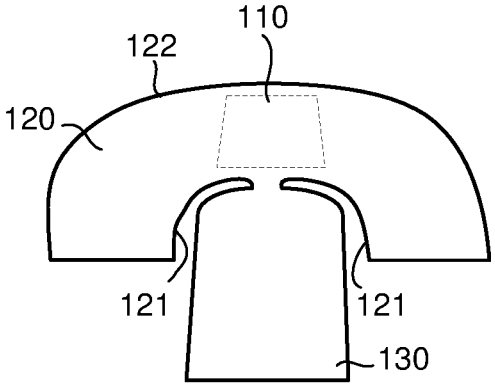
FIG. 4B is a top view of one embodiment of a diaper changing apparatus.

FIG. 4A is a top view of one embodiment of the diaper changing apparatus 100 showing an asymmetrical barrier panel 120. As depicted, the barrier panel 120 is not required to couple to itself at a point equidistant from the underlay segment 110. For example, one arm of the barrier panel 120 may be long enough to wrap around the torso/chest 55 of the baby 50 in order to couple with a complimentary attachment means 123 disposed near or mounted on the underlay segment 110 (as depicted in FIG. 4A). In yet another embodiment, the attachment means 123 may be located directly underneath the baby, thereby allowing the underlay segment 110 and the attachment means 123 to occupy substantially the same space. FIG. 4B is a top view of one embodiment of the diaper changing apparatus 100. In one embodiment, the changing pad 130 may be connected to the underlay segment 110 and the barrier panel 120 by a narrow patch of material, thus allowing the shape/dimensions of the proximal edge 121 to be further customized.

Figure 4C:
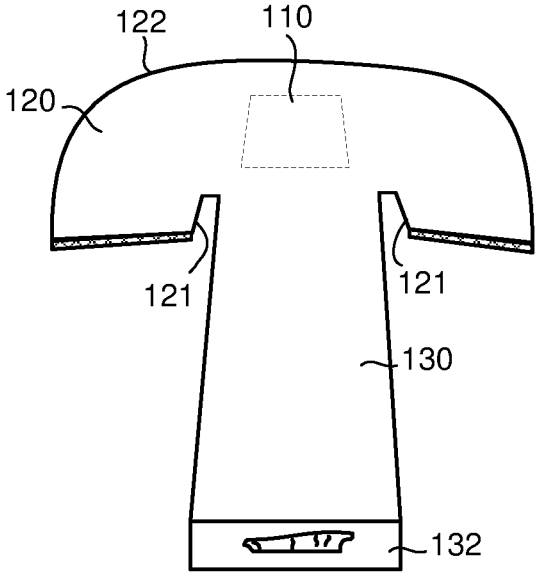
FIG. 4C is a top view of one embodiment of a diaper changing apparatus showing a changing pad with a wipe dispenser portion.

FIG. 4C is a top view of one embodiment of the diaper changing apparatus 100 showing the changing pad 130 with a wipe dispenser portion 132. The wipe dispenser portion 132 may be a pouch or a pocket that conveniently stores and positions baby wipes so that the diaper changing attendant can easily access and use the wipes during the changing procedure. It is expected that other accessories, such as pouches, pockets, straps, belts, handles, etc., may be implemented in conjunction with the apparatus 100 to further facilitate an efficient, comfortable, and stress-free diaper changing procedure. It is expected that other configurations and orientations of the portions 110, 120, 130 of the apparatus are possible to be implemented and such other configurations and orientations fall within the scope of the present disclosure. For example, the various dimensions and sizes may vary according to the specifics of a given application.

Figure 5A:
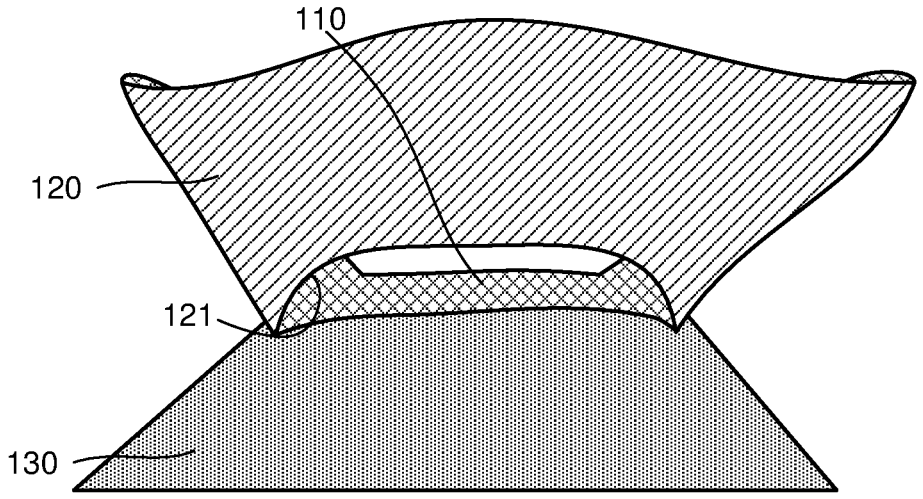
FIG. 5A is a perspective side view of one embodiment of a diaper changing apparatus showing a barrier panel with a c-shaped proximal edge.
Figure 5B:
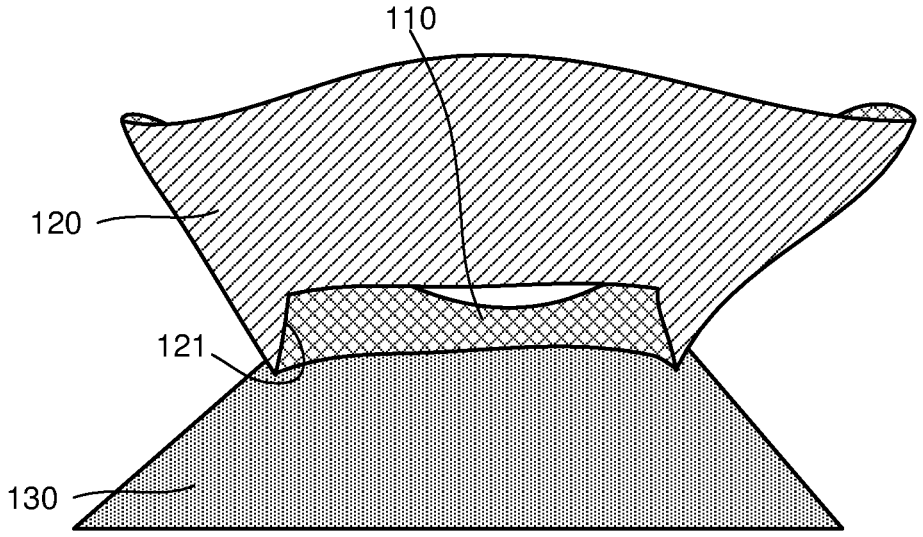
FIG. 5B is a perspective side view of another embodiment of a diaper changing apparatus showing a barrier panel with a rectangular-shaped or T-shaped proximal edge.

FIG. 5A is a perspective side view of one embodiment of the diaper changing apparatus 100 showing the barrier panel 120 with a c-shaped proximal edge 121 that forms a hemisphere chest gap. FIG. 5B is a perspective side view of another embodiment of the diaper changing apparatus 100 showing the barrier panel 120 with a rectangular-shaped or T-shaped proximal edge 121 that forms a rectangular chest gap. Both FIGS. 5A and 5B are depicted from a viewpoint of the baby's feet looking towards the head of the baby, although no baby is depicted in FIGS. 5A-B. It is expected that the proximal edge 121 extending over the baby may have other shapes, such as polygonal, triangular, etc., depending on the specifics of a given application. As described above, the proximal edge 121 may further include an elastic band liner that functions to snugly secure around the chest of the baby 50.

Figure 6A:
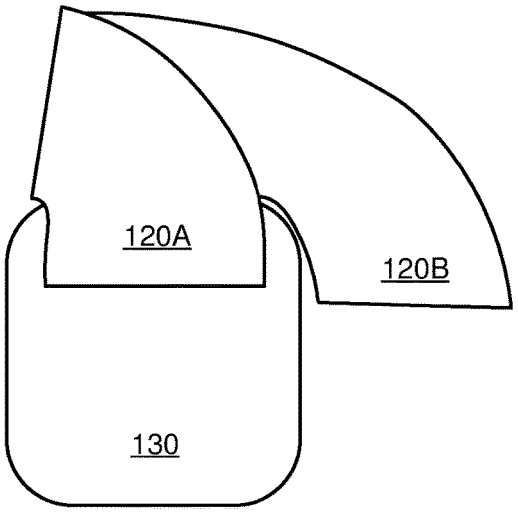
FIG. 6A is a perspective view of one embodiment of a step for folding a diaper changing apparatus.
Figure 6B:
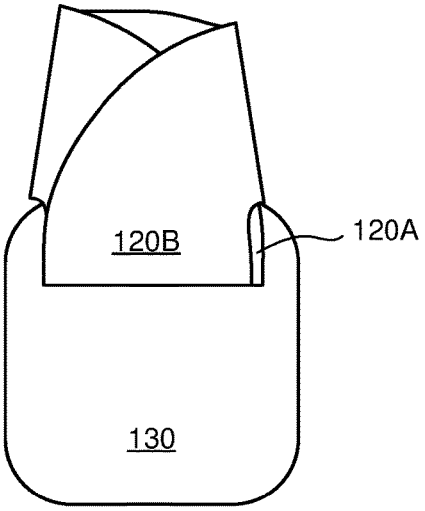
FIG. 6B is a perspective view of another embodiment of a step for folding a diaper changing apparatus.

FIG. 6A is a perspective view of one embodiment of a first step for folding the diaper changing apparatus 100, wherein a first end of the barrier panel 120 is folded inward toward the underlay segment 110. FIG. 6B is a perspective view of one embodiment of a second step for folding the diaper changing apparatus 100, wherein a second end of the barrier panel 120 opposite the first end is folded inward toward the underlay segment 110. In FIGS. 6A and 6B, the first and second ends of the barrier panel 120 are folded to overlap the underlay segment 110.

Figure 6C:
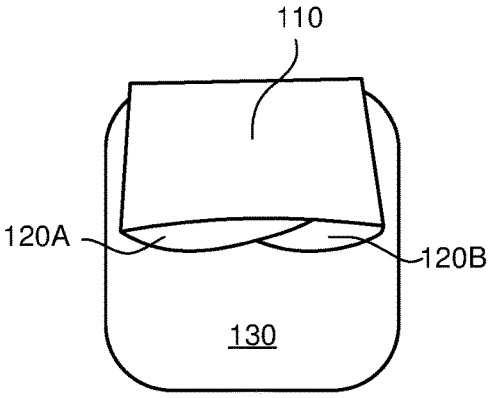
FIG. 6C is a perspective view of a further embodiment of a step for folding a diaper changing apparatus.
Figure 6D:
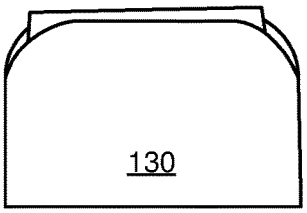
FIG. 6D is a perspective view of one embodiment of a folded diaper changing apparatus.

FIG. 6C is a perspective view of one embodiment of a third step for folding the diaper changing apparatus 100, wherein the underlay segment 110 and the folded first and second ends of the barrier panel 120 are folded toward the changing pad 130. FIG. 6D is a perspective view of one embodiment of a folded diaper changing apparatus 100, wherein a fold has been made in the changing pad 130 to enclose the folded underlay segment 110 and barrier panel 120.

In certain embodiments, the changing pad 130 may comprise an attachment means (e.g., snap, Velcro®, button, hook) to secure the folded end of the changing pad 130 to an opposing surface, or the like. In certain embodiments, as depicted in FIGS. 6A-6D, the diaper changing apparatus 100 may be formed from a pliable, flexible, and/or foldable material (e.g., flexible fabric, textile, plastic, polymer, laminate, composite, or the like) to facilitate portability and storage of the diaper changing apparatus 100.

Figure 7:
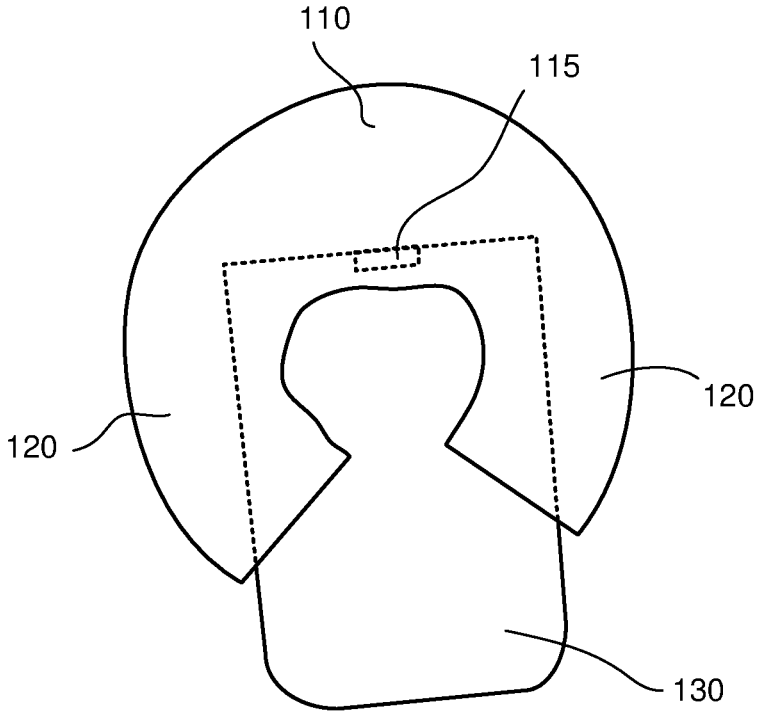
FIG. 7 is a top view of one embodiment of a diaper changing apparatus.

FIG. 7 is a top view of one embodiment of the diaper changing apparatus 100. In the depicted embodiment, the changing pad 130 is coupled to the underlay segment 110 above the proximal edge 121, at a distance at least slightly removed from the proximal edge 121 toward an interior of the underlay segment 110. As mentioned above, the changing pad 130 may be sewn, bonded, detachably coupled, or otherwise fastened to the underlay segment at 115. The barrier panel 120, in the depicted embodiment, extends out in three-quarters of a circle, or an extended-c shape. In certain embodiments, the diaper changing apparatus 100 of FIG. 7 may result in a wider cone, a more compact apparatus 100, or the like than one or more other designs for the diaper changing apparatus 100.

Figure 8:
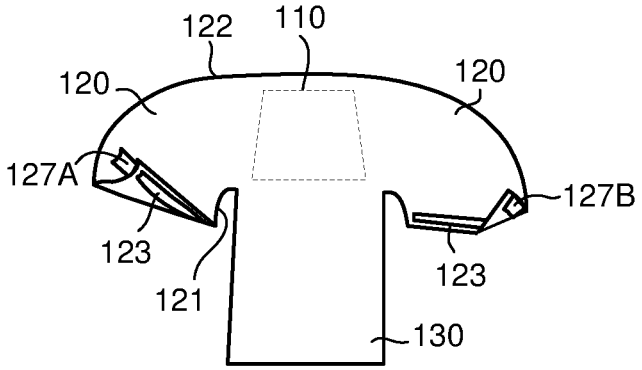
FIG. 8 is a top view of one embodiment of a diaper changing apparatus showing an attachment means for coupling a barrier panel about a baby (not depicted)

FIG. 8 is a top view of one embodiment of a diaper changing apparatus 100 showing two attachment means 123, 127A, 127B for coupling the barrier panel 120 about a baby. As described above the barrier panel 120 may include portions that overlap and/or that otherwise connect together via fasteners 123 (e.g., Velcro®, etc). In another embodiment, the barrier panel 120 may have one or more tabs 127A that extend from the barrier panel and that wrap around and engage a corresponding area/portion 127B of the opposite barrier panel section when the barrier panel is extended around the chest of the baby. The tab 127A or flap helps secure the barrier panel after it is coupled in place. The tab 127A that folds over may be the exclusive fastener means or the table 127A may function as extra strength to the barrier panel that has already been fastened.

Figure 9:
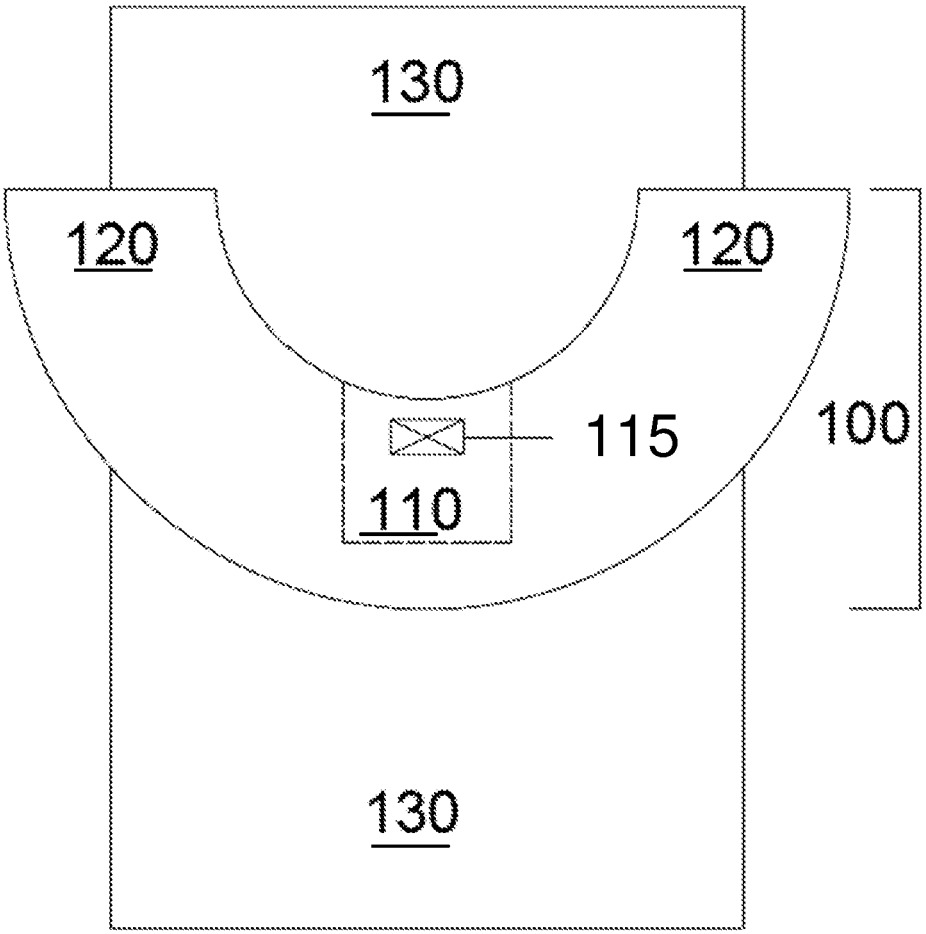
FIG. 9 is a top view of one embodiment of a diaper changing apparatus.

The tab/flap 127A may have Velcro or other connecting means on the back side so that when the barrier is coupled together it can attach to the opposite side of the barrier. When the barrier is folded up into place, the two sides of the barrier may first be attached via the main coupling devices 123 before the flap is folded over the top of the barrier panel and attached to fastener 127B on the other side. This tab 127A makes it difficult for the baby to unfasten the barrier FIG. 9 is a top view of one embodiment of the diaper changing apparatus. FIG. 9 shows a variation of the changing apparatus 100 where the baby's middle or lower back (baby not depicted) would lay on the underlay 110 and the barrier panels 120 would be positioned upwards towards the baby's head forming a general U-shape when viewed from above. Once again, the underlay segment 110 may be connected to the changing pad 130 at 115.

Figure 10A:
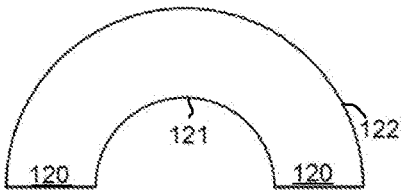
FIGS. 10A-10K are top view of various shapes of the barrier panel, according various embodiments.
Figure 10B:
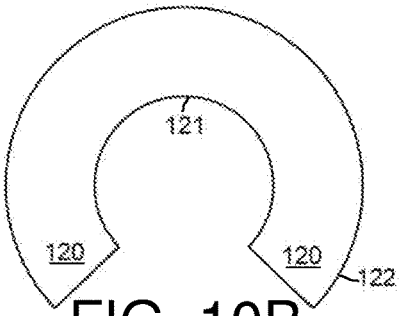
Figure 10C:
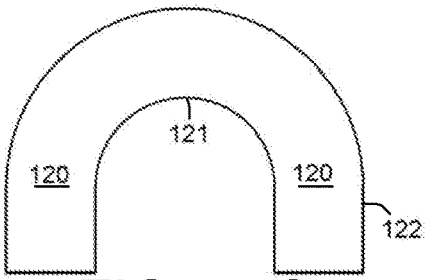
Figure 10D:
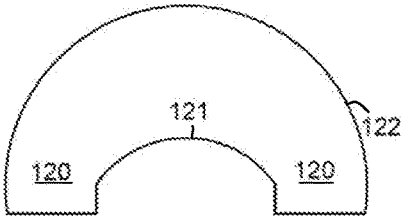
Figure 10E:
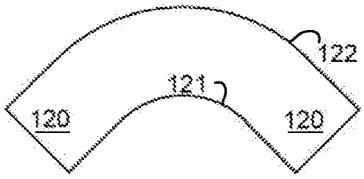
Figure 10F:
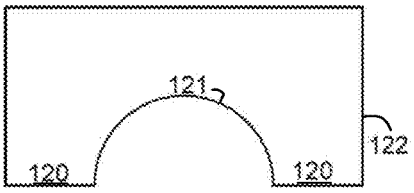
Figure 10G:
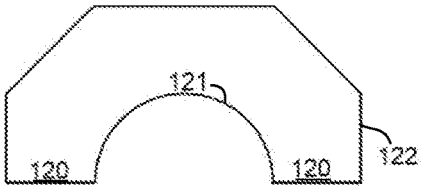
Figure 10H:
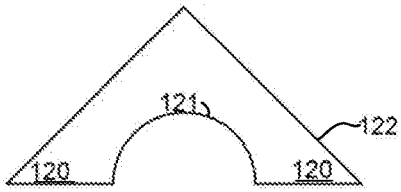
Figure 10I:
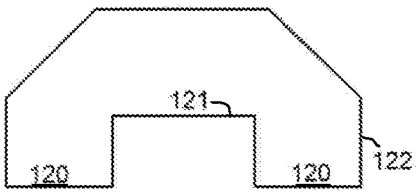
Figure 10J:
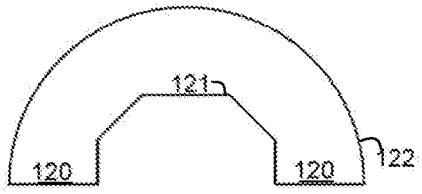
Figure 10K:
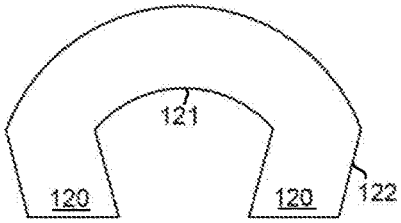

FIGS. 10A-K are top view of various shapes of the barrier panel and underlay according to various embodiments. Many shapes can be used for the proximal edge 121 and distal edge 122 that can fold up into a barrier. Some have been shown earlier that are c shaped and rectangular shaped. However, FIGS. 10A-K show various other examples of other shapes, formations, and configurations that may be implemented as the barrier panel 120. For example, the barrier panel 120 can extend further down as seen in FIG. 10B, which would cause the barrier panel to lean further away from the baby's face and more towards their lower body. On the other hand, as seen in FIG. 10E, the barrier panel 120 can be extended outward causing the barrier panel (when coupled about the baby) to close closer to the baby's face and further away from the lower body of the baby. The barrier panel can include, but is not limited to, the combinations, shapes, and configurations depicted in these figures.

Figure 11:
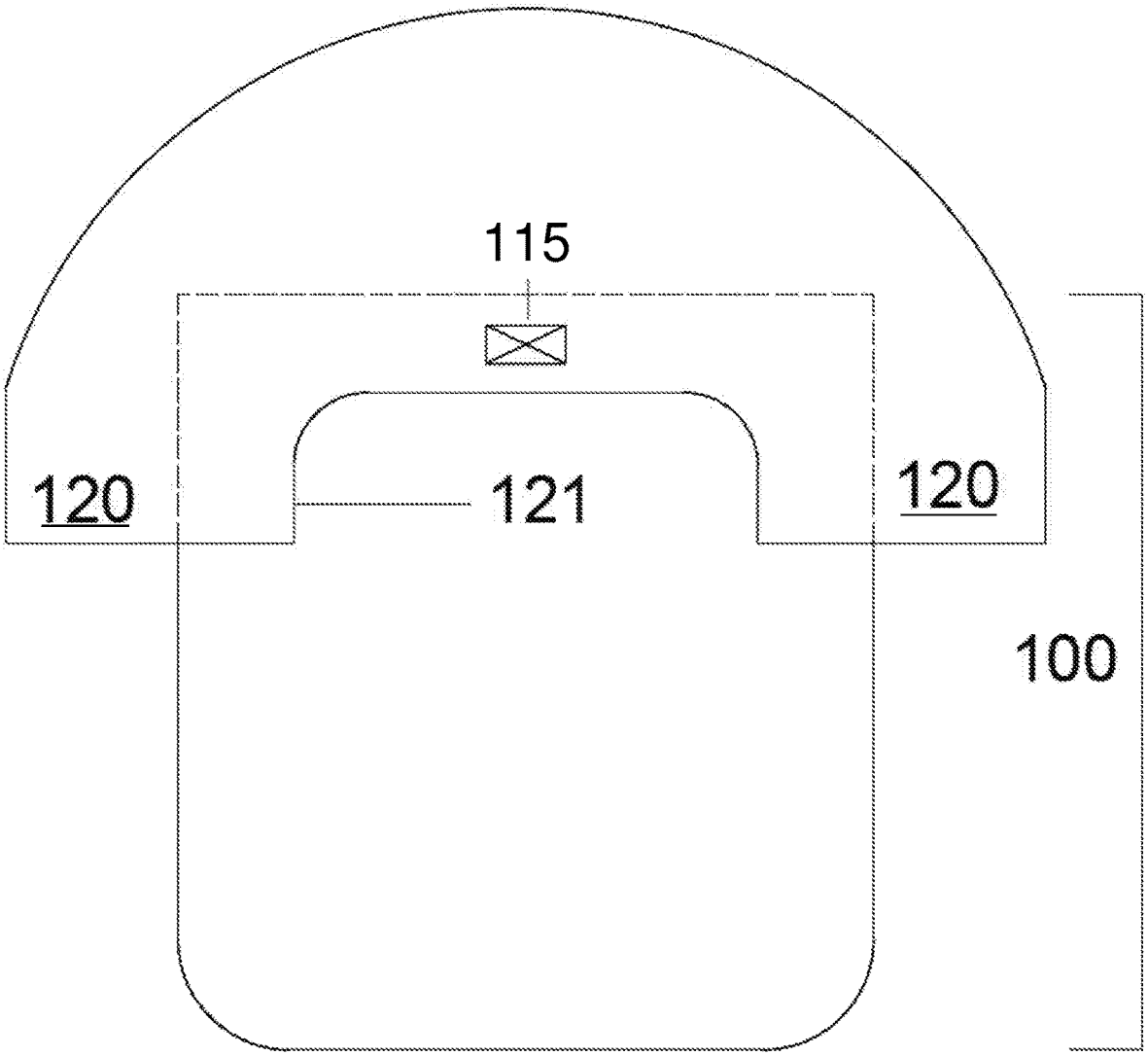
FIG. 11 is a top view of another embodiment of a diaper changing apparatus.

FIG. 11 is a top view of another embodiment of the diaper changing apparatus that shows a way of overlapping and connecting the changing apparatus 100 to the changing pad 130 by a small connecting material 115. In FIG. 11. The changing apparatus 100 is connected to the changing pad 130 either permanently by sewing or some other means, or in a removable manner with Velcro or other removable connection means. This allows for maneuverability of the barrier panel 120 and gives more flexibility to the proximal edge 121. For example, the changing pad 130 may have connecting material 115 along its length, thus allowing the user to select where, with respect to the length of the changing pad 130, to connect the barrier panel 120. It also allows the changing pad 130 to be overlapped with the changing apparatus 100 in order to ensure that no part of the baby comes in contact with the ground or surface the changing pad is placed upon when the changing pad is pulled up into the barrier position.

Figure 12A:
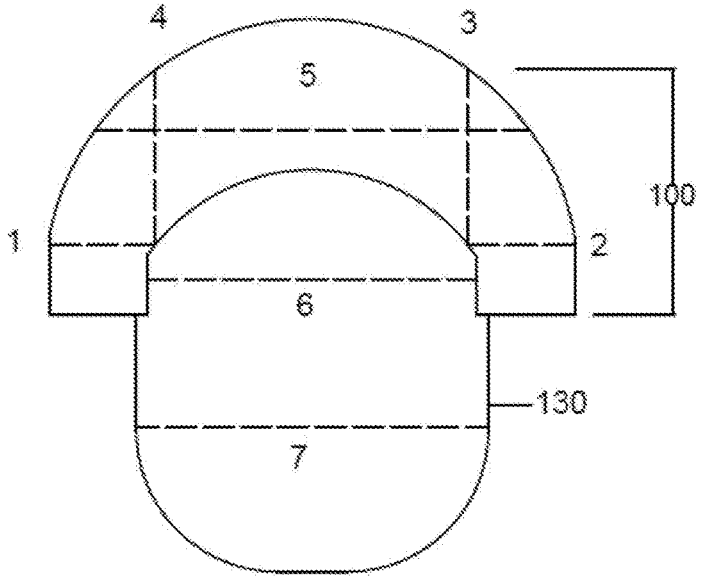
FIGS. 12A-12D are top views of various embodiments for folding the apparatus.
Figure 12B:
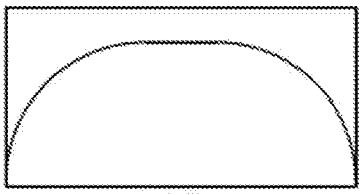

FIGS. 12A-12D are top views of various embodiments for folding the apparatus with dotted lines representing the fold creases. Any ribs or stiffening structures would be placed in pockets, sewn within the material, or given hinges in a way that the material can easily fold on the dotted fold lines. For example, FIG. 12A shows possible fold lines for a comparatively thicker yet shorter folding scheme. The fold lines shown in FIG. 12A are listed in numeric order (according to one embodiment). In one implementation, the sequential folding along the fold lines will result in the compact, folded apparatus shown in FIG. 12B.

Figure 12C:
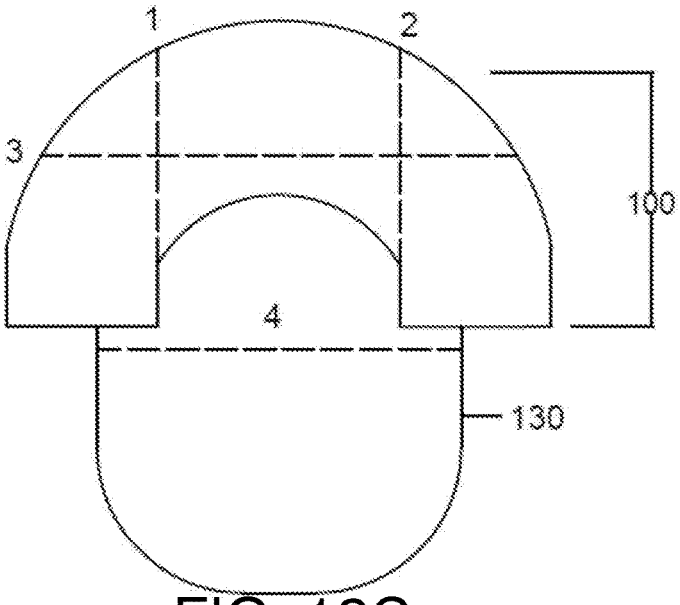
Figure 12D:
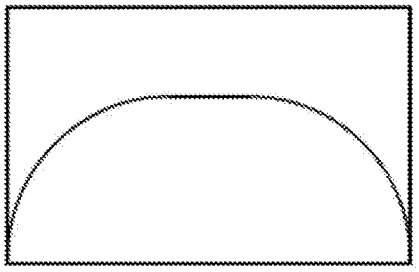

Similarly, FIG. 12C shows fold lines for a thinner yet longer folding scheme and FIG. 12D shows the compact, folded form of the apparatus shown in FIG. 12C. The compact/folded form may include various fasteners (e.g., Velcro®) that hold various components together in the compact form. In a further embodiment, a pouch may be formed upon folding up the apparatus and wipes, diapers, or other diaper changing supplies may be stored within the pouch. In yet another embodiment, the apparatus may include a vertical fold line that would allow the apparatus to be further folded, according to the specifics of a given application.

Figure 13A:
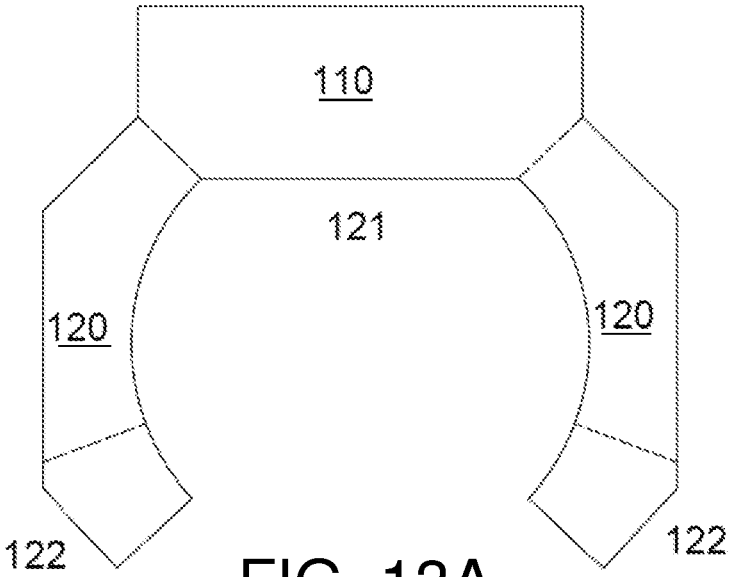
FIGS. 13A-13B are top views of further embodiments of the barrier panel.
Figure 13B:
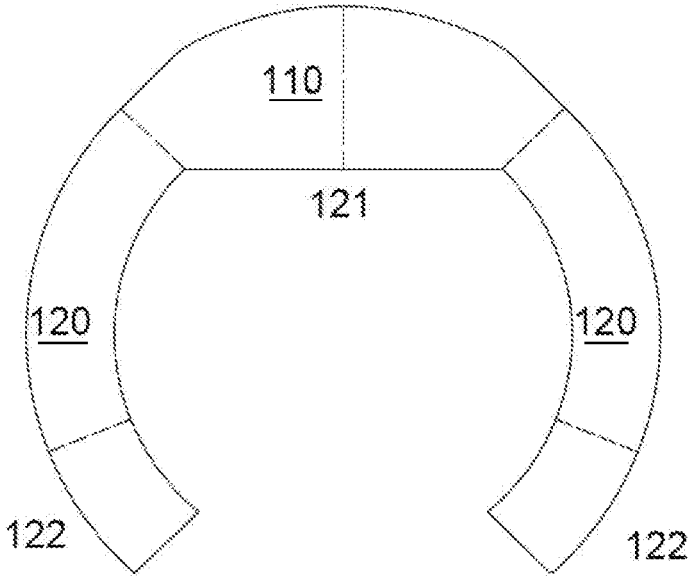

FIGS. 13A-13B are top views of further embodiments of the barrier panel. FIG. 13 shows some other variations of the apparatus in which various components of the apparatus are hingedly coupled together. For example, it is possible to also make the apparatus using material that doesn't flex like fabric or thin plastic, but instead is firm.

FIG. 13A shows a structure that is made from stiff material that hinges on the dotted lines in order to couple about the baby to form the barrier. The barrier wouldn't have a rounded cone shape but would still function in a similar manner to the cone shapes depicted earlier. FIG. 13B shows another variation of the same idea with an extra hinge in the middle of the underlay segment 110 to allow the apparatus to fold smaller for storage.

Figure 14A:
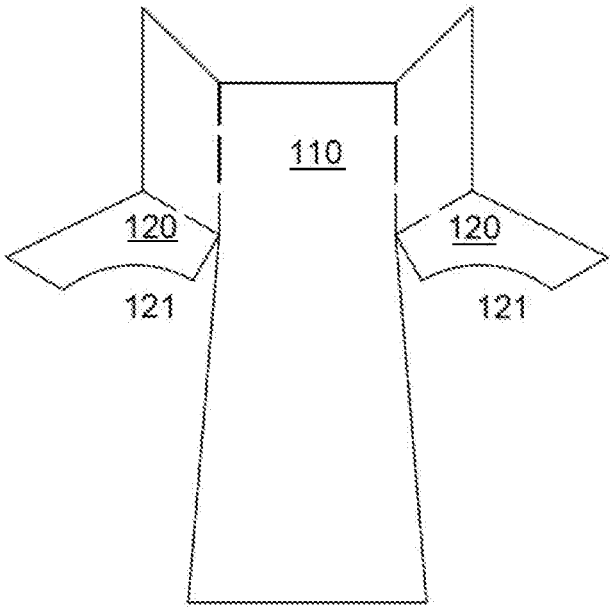
FIGS. 14A-14D are top view of various shapes and features of the diaper changing apparatus, according to various embodiments.
Figure 14B:
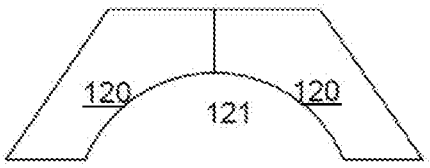
Figure 14C:
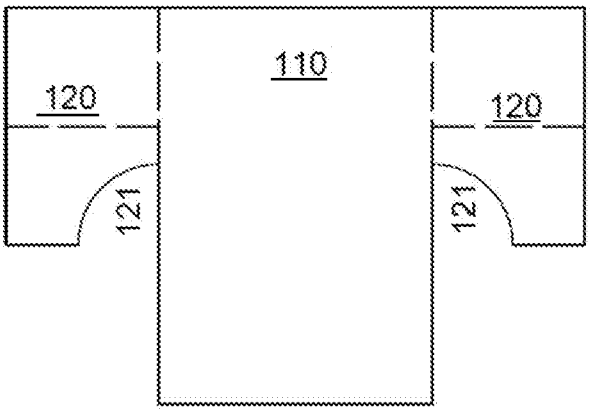
Figure 14D:
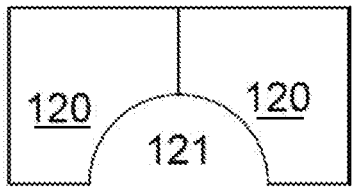

FIGS. 14A-D are top view of various shapes and features of the diaper changing apparatus, according to various embodiments. FIGS. 14A-D shows additional variations to the shape of the barrier panel. As mentioned above, the barrier panel 120 may form a pyramid shape or a rectangular box shape, among others. With some minor variations in shape, the same concept can form different barrier shapes. FIG. 14A shows a pattern that could form a pyramid shape with barrier arms that point outward when laid flat. The dotted lines are where it folds to put the barrier in place. When folded on the dotted lines, the barrier arms would be able to then couple to form the barrier, and uncouple again to be laid flat. FIG. 14B shows a similar concept that would form an open box instead of a pyramid.

Figure 15:
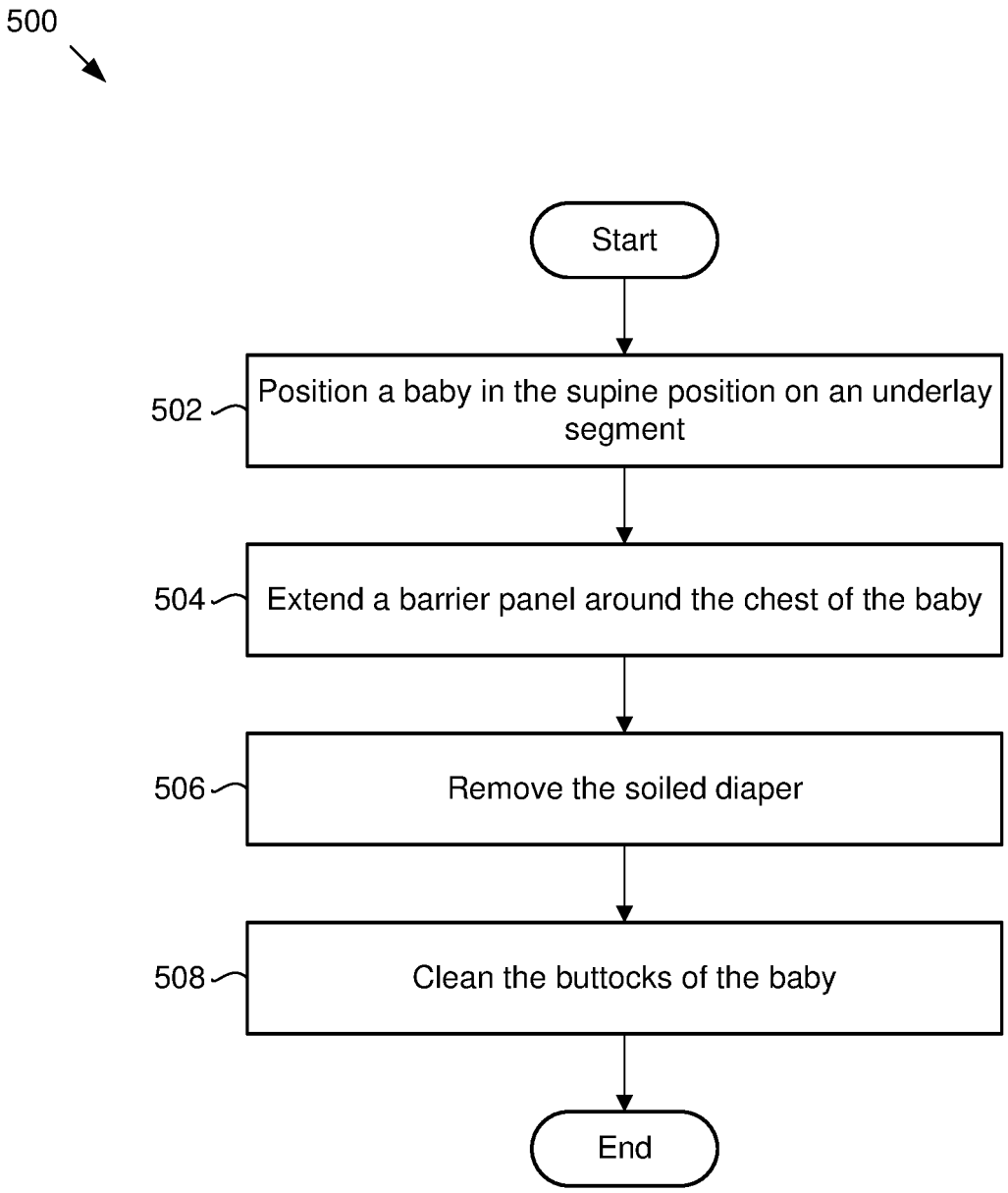
FIG. 15 is a schematic flow chart diagram of one embodiment of a method for changing a soiled diaper.

FIG. 15 is a schematic flow chart diagram of one embodiment of a method 500 for changing a soiled diaper. The method 500 includes positioning the baby in the supine position on an underlay segment of a diaper changing apparatus, wherein at least one of the shoulders, the head, the back, and the buttocks of the baby are in contact with the underlay segment at 502. The method 500 further includes extending a barrier panel that is coupled to the underlay segment around the chest of the baby to form a partition between an upper body portion and a lower body portion of the baby at 504. Still further, the method 500 includes removing the soiled diaper from the buttocks of the baby at 506 and cleaning the buttocks of the baby at 508. The method 500 may further include the steps of replacing the soiled diaper with a new diaper and decoupling the barrier panel to remove the baby from the apparatus.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. An apparatus comprising:

an underlay segment positionable underneath at least one of a shoulder, a head, a back, and buttocks of a user lying in a supine position; and a barrier panel coupled to the underlay segment to lay substantially flat with the underlay segment in a first position, the barrier panel extendable around the user to form a partition between an upper body portion and a lower body portion of the user in a second position flexibly folded from the first position, the barrier panel comprising a proximal edge and a distal edge, the proximal edge shaped to contour the user and the distal edge extending outwardly and upwardly from the upper body portion of the user in the second position, wherein the barrier panel is foldable.

2. The apparatus of claim 1, further comprising a changing pad extending from the underlay segment, the changing pad positionable underneath at least part of the lower body portion of the user.

3. The apparatus of claim 2, wherein the changing pad, the underlay segment, and at least a portion of the barrier panel comprise a flexible, foldable, non-rigid material.

4. The apparatus of claim 3, wherein the apparatus is foldable to form a pouch for holding diaper changing supplies.

5. The apparatus of claim 2, wherein the changing pad, the underlay segment, and the barrier panel are permanently connected.

6. The apparatus of claim 2, wherein the changing pad and the underlay segment are detachably coupled together.

7. The apparatus of claim 2, wherein the changing pad comprises a wipe dispenser portion.

8. The apparatus of claim 1, wherein the underlay segment and the barrier panel are permanently connected.

9. The apparatus of claim 8, wherein the underlay segment and the barrier panel are formed of the same, unitary material.

10. The apparatus of claim 1, wherein the proximal edge is shaped to rest on a chest or abdomen of the user and engagement between the proximal edge and the chest or abdomen of the user supports the distal edge to extend outwardly and upwardly from the upper body portion of the user.

11. The apparatus of claim 1, wherein the underlay segment and the barrier panel are detachably coupled together.

12. The apparatus of claim 1, wherein the barrier panel further comprises attachment means for securing the barrier panel around a chest of the user and adjustment means for adjusting to the size of the user.

13. The apparatus of claim 1, wherein the barrier panel further comprises stiffener means for imparting sufficient structure to the barrier panel to prevent the barrier panel from collapsing, thereby maintaining at least a portion of the barrier panel suspended above the lower body portion of the user.

14. The apparatus of claim 1, wherein the proximal edge is substantially c-shaped.

15. An apparatus comprising:

an underlay segment positionable underneath at least one of a shoulder, a head, a back, and buttocks of a user lying in a supine position;

a barrier panel coupled to the underlay segment to lay substantially flat with the underlay segment in a first position, the barrier panel extendable around the user to form a partition between an upper body portion and a lower body portion of the user in a second position flexibly folded from the first position, the barrier panel comprising a proximal edge and a distal edge, the proximal edge shaped to contour the user and to rest on the user, wherein engagement between the proximal edge and the user supports the distal edge to extend outwardly and upwardly from the upper body portion of the user in the second position, wherein the barrier panel is foldable; and a changing pad extending from the underlay segment, the changing pad positionable underneath at least part of the lower body portion of the user.

16. The apparatus of claim 15, wherein the apparatus is foldable to form a pouch for holding diaper changing supplies.

17. The apparatus of claim 15, wherein the barrier panel further comprises attachment means for securing the barrier panel around a chest of the user.

18. The apparatus of claim 15, wherein the barrier panel further comprises adjustment means for adjusting to the size of the user.

19. A method comprising:

positioning a user in a supine position on an underlay segment, wherein at least one of a shoulder, a head, a back, and buttocks of the user are in contact with the underlay segment; and extending a barrier panel, that is coupled to the underlay segment, to lay substantially flat with the underlay segment in a first position, around the user to form a partition between an upper body portion and a lower body portion of the user in a second position flexibly folded from the first position, wherein the barrier panel comprises a proximal edge that rests against the user in the second position, wherein the barrier panel is foldable.

20. The method of claim 19, wherein extending the barrier panel around the user comprises coupling ends of the barrier panel together using fastening means.

* * * * *